United States Patent [19]

Mullen, III et al.

[11] 4,312,369

[45] Jan. 26, 1982

[54] SCREEN HOLDING APPARATUS IN A LIQUID CRYOGEN PRESSURE VESSEL

[75] Inventors: Thomas W. Mullen, III, Richmond; Richard M. Hultz, Mechanicsville, both of Va.; Thomas O. Turner, Midland, N.C.

[73] Assignee: Philip Morris, Inc., New York, N.Y.

[21] Appl. No.: 106,521

[22] Filed: Dec. 26, 1979

[51] Int. Cl.[3] ..... A24B 3/18

[52] U.S. Cl. ..... 131/290; 131/291; 131/300; 131/900; 62/64; 62/384; 62/340; 62/47

[58] Field of Search ..... 131/120, 121, 140 P, 131/140 R, 140 B, 290, 291, 300, 306, 900; 62/62, 64, 384, 340, 47, 35, 57

[56] References Cited

U.S. PATENT DOCUMENTS 3,857,254 12/1974 Lobel ..... 62/64

4,165,618 8/1979 Tyree, Jr. ..... 62/64

*Primary Examiner*—V. Millin

*Attorney, Agent, or Firm*—Arthur I. Palmer, Jr.; George E. Inskeep

[57] ABSTRACT

In a pressure vessel of the type used for processing a product with a liquid cryogen such as the impregnation of tobacco with liquid carbon dioxide for expansion thereof, a withdrawal door, pivotally hinged to open to permit gravitational discharge of the processed product, includes a grating to support the product in the vessel when the door is closed. A wire screen mesh is disposed on the grating to permit gaseous and liquid cryogen to pass therethrough while substantially preventing product from passing therethrough. A holding apparatus includes means for securely holding the screen fixed relative to the grating at the periphery and interior surface portions of the screen, the apparatus preferably including a gridded structure for minimizing stretching and tearing of the screen during discharge of the processed product from the vessel.

6 Claims, 4 Drawing Figures

SCREEN HOLDING APPARATUS IN A LIQUID CRYOGEN PRESSURE VESSEL

BACKGROUND OF THE INVENTION

1. Field of the Invention

This invention relates to a pressure vessel used in processing a product with a liquid cryogen and more particularly to an apparatus in such vessel for securely holding a wire mesh screen on a discharge door of the vessel to minimize stretching and tearing of the screen during discharge of the processed product.

2. Description of the Prior Art

The use of liquid cryogens for refrigeration and other processing of products has increased significantly with the increase in availability of cryogens, such as, for example, nitrogen, oxygen, argon, hydrogen, helium, methane, freon ® refrigerants, carbon monoxide and carbon dioxide. One fairly recently discovered use involves the expansion of tobacco in which liquid carbon dioxide is employed as the expansion agent. A process and apparatus for so expanding tobacco are described in patent applications U.S. Ser. No. 441,767 filed by Roger Z. de la Burde and Patrick E. Aument on Feb. 12, 1974 and U.S. Ser. No. 822,793 filed by Larry M. Sykes and Ray G. Snow on Aug. 8, 1977, both applications being assigned to the same assignee as is the present invention. A method and apparatus for treating a product, including food and tobacco with a liquid cryogen is described in U.S. Pat. No. 4,165,618 to Lewis Tyree, Jr., issued on Aug. 28, 1979.

In these instances of the use of liquid carbon dioxide for processing tobacco, a pressure vessel or chamber is utilized to process the tobacco at desired pressures. Such a vessel typically has a pivotally hinged lid through which the product can be added by a gravity feed and a pivotally hinged bottom door that opens to allow a gravitational discharge of the processed product.

Included in the bottom door in certain apparatuses is a structure for supporting the tobacco in the vessel while the bottom door is closed. Since the charge of tobacco to be processed can weigh as much as 750 pounds, the supporting structure in the door must be relatively rugged and capable of withstanding such loads. Also, as described in the referenced materials, liquid carbon dioxide as well as gaseous carbon dioxide are generally fed through the door and also through the supporting structure to contact the tobacco in the vessel. Thus, the supporting structure typically comprises a metal grating or the like capable of supporting the tobacco load covered by a permeable member such as a wire mesh screen having a mesh size for preventing tobacco from passing through while allowing the gaseous and liquid carbon dioxide to pass therethrough.

In one instance, for example, the wire mesh screen is attached to the grating as by clamping the screen at its periphery by a flat ring that is bolted to the bottom door thereby compressing the screen periphery between the ring and grating. One problem associated with such a support structure occurs as the processed tobacco is discharged from the vessel. In the expansion process, for example, after the liquid carbon dioxide is brought into contact with the tobacco and thoroughly impregnates the tobacco, the excess liquid is removed and the carbon dioxide contained in the tobacco is converted to solid carbon dioxide therein. During this conversion the impregnated tobacco has a tendency to stick to the mesh screen. Upon opening the bottom door to discharge the tobacco containing the solid carbon dioxide there is a further tendency due to the sticking of the tobacco and the sliding effect imparted along the screen by the falling tobacco to deleteriously stretch and tear the mesh screen. As a result of this problem, it is often required to replace the screen and the clamping ring, thereby undesirably stopping production and increasing costs. It is therefore desirable to provide a supporting structure in the discharge door of the processing vessel in which the damage to the screen or other permeable member during the withdrawal of the processed tobacco is minimized, if not eliminated.

SUMMARY OF THE INVENTION

In accordance with the invention there is provided in a pressure vessel of the type used for processing a product with a liquid cryogen an apparatus for minimizing stretching and tearing of a permeable member during discharge of the processed material from the vessel, the permeable member being mounted in the product withdrawal door of the vessel. In addition, the vessel includes means such as a lid for introducing the product to be processed. The withdrawal door, pivotally hinged to open to permit gravitational discharge of the processed product, includes a grating to support the product in the vessel when the withdrawal door is closed. A permeable member, such as wire mesh screen, is disposed on the grating to permit gaseous and liquid cryogen to pass therethrough while substantially preventing product from passing therethrough. The apparatus comprises means for securely holding the permeable member fixed relative to the grating at a location proximate the periphery and at a location on the permeable member interiorly of the periphery of the permeable member.

In the preferred form, the pressure vessel is of the type used for impregnating tobacco with liquid carbon dioxide and converting the liquid carbon dioxide impregnating the tobacco to solid carbon dioxide. The permeable member is a wire mesh screen that is securely held against the grating by a grid that has a peripheral portion that substantially conforms to the periphery of the screen and a plurality of strips attached to the peripheral portion of the grid, the strips being angularly joined interiorly of the peripheral portion to hold the interior surface portions of the mesh screen against the grating.

In this preferred form, the wire mesh screen and the grating are circular, the diameter of the mesh screen being greater than the diameter of the grating. The periphery of the screen is folded around and beneath a retention ring that has an outer diameter approximately the same as the diameter of the grating. Means are included for securing the grid to the door such that the folded peripheral portion of the mesh screen is held between the retention ring and the grating, the outer radial unfolded portion of the screen is held between the outer peripheral portion of the grid and the retention ring and the interior surface portion of the screen is held between the joined strips and the grating.

DETAILED DESCRIPTION OF THE PREFERRED EMBODIMENTS

Figure 1:
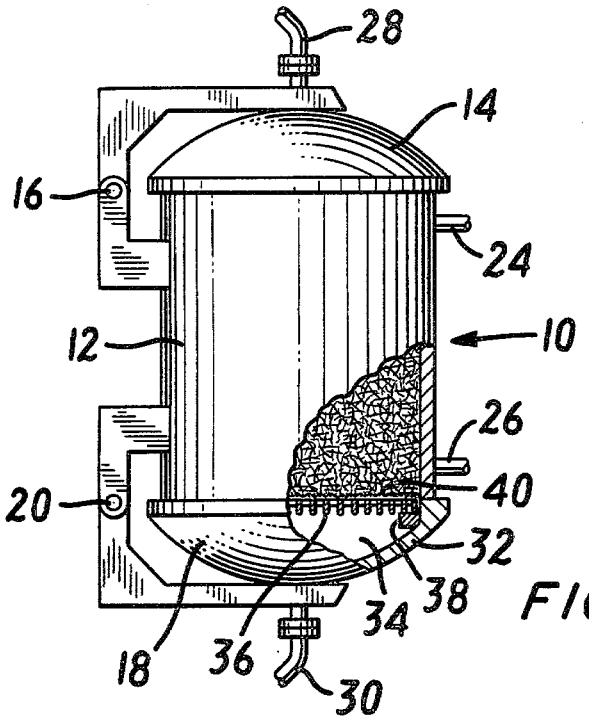
FIG. 1 is a side elevational view of a pressure vessel including an apparatus in accordance with the invention, partly broken away to show portions of the support structure in the vessel door and product in the vessel for processing.
Figure 2:
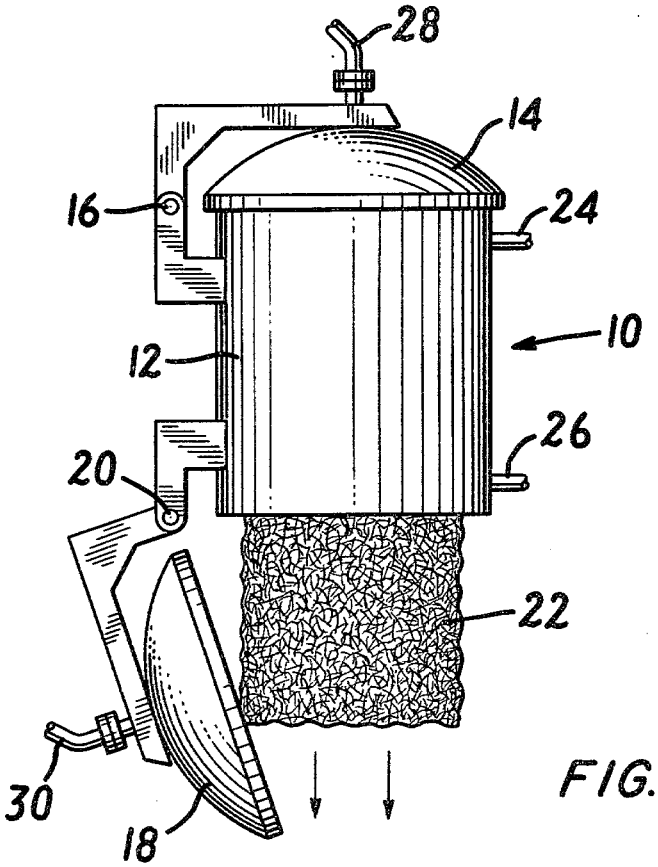
FIG. 2 is a view of the vessel of FIG. 1 showing the lower vessel door opened and processed product being discharged from the vessel.

Referring to the drawing, there is shown in FIGS. 1 and 2 a pressure vessel 10 of the type used for processing a product such as tobacco or food with a liquid cryogen as described in U.S. Pat. No. 4,165,618 issued to Lewis Tyree, Jr., on Aug. 28, 1979. Preferably, the pressure vessel is of the type used for expanding tobacco wherein the tobacco is impregnated with liquid carbon dioxide and the liquid carbon dioxide impregnating the tobacco is converted into solid carbon dioxide therein as described in patent applications U.S. Ser. No. 441,767, filed Feb. 12, 1974 and U.S. Ser. No. 822,793, filed Aug. 8, 1977. After the carbon dioxide impregnating the tobacco is converted to a solid, the treated tobacco is withdrawn from the vessel 10 and then subjected to conditions of temperature and pressure, preferably by rapid heating at atmospheric pressure, such that the solid carbon dioxide is vaporized and the tobacco is thereby expanded. The present invention is concerned with the structure of the withdrawal means of the vessel 10 and in particular with an apparatus for minimizing damage to the withdrawal means upon discharge of the processed product from the vessel 10.

The vessel 10 includes a chamber 12 fitted with an upper lid 14 that pivots about a hinge 16 such that the lid 14 can be opened to permit supply of product to be processed as by, for example, a gravity feed from a conveyor (not shown) or the like. The treatment chamber 12 may be sized to accept, for example, a charge of 750 pounds of tobacco having pores into which a liquid carbon dioxide can penetrate. Following entry of the tobacco, the upper lid is closed and clamped shut to provide a pressure-tight enclosure wherein the treatment will occur.

The vessel 10 is provided with a bottom door 18 similar to the upper lid 14, the bottom door 18 being pivotally connected to a hinge 20 such that when the door 18 is unlatched the processed tobacco 22 will be discharged by gravity, as shown in FIG. 2. The vessel 10 is further provided with ported connections 24 and 26 near the top and bottom of the chamber 12, respectively as well as lines 28 and 30 through the lid 14 and the bottom door 18, respectively. These connections and lines allow for purging the interior of the chamber 12 with a gaseous medium, such as gaseous carbon dioxide and introducing and removing liquid carbon dioxide. Preferably, the liquid carbon dioxide is introduced and withdrawn through line 30 that passes through the bottom door 18. All the connections and outlets are suitably closed to permit the pressure in the chamber 10 to be brought up to desired processing levels.

The door 18 is provided with a support structure for supporting the tobacco in the chamber 12, the support structure being capable of permitting the gaseous and liquid carbon dioxide to pass therethrough for contacting the tobacco. As illustrated in FIGS. 1 and 2, the chamber 12 of the pressure vessel 10 is preferably cylindrical, the hinged lid 14 and door 18 each preferably having a circular surface at the interface with the chamber 12. As depicted in FIG. 1, the door 18 comprises a dome shaped outer wall 32 that defines an inner space 34 within the door 18. Traversing this space 34 is a grating 36 of metal or other suitable materials capable of supporting loads, for example, in excess of 750 pounds. The grating is mounted on a shoulder 38 attached to the wall 32, the shoulder being formed radially interiorly of the door 18. The shoulder 38 may extend completely around the door 18 or may be a number of pedestals disposed intermittently and preferably equidistantly around the inner periphery of the wall 32.

Disposed on the grating 36 is a permeable member 40 such as a wire mesh screen. The screen 40 is provided to permit gaseous and liquid carbon dioxide to pass therethrough for ultimate contact with the tobacco while preventing the tobacco from passing therethrough into the space 34 and undesirably into the liquid carbon dioxide line 30. The wire mesh screen is preferably formed of type 304 stainless steel having a 50 mesh opening size, although mesh sizes of between 20 and 100 are also useful.

In accordance with the invention the wire mesh screen 40 is held securely fixed relative to the grating 36 at the periphery and interior surface portions of the screen 40 to minimize or prevent damage to the screen 40 during discharge of the processed tobacco 22. As shown in FIG. 2, it can be seen that as the door 12 is unlatched, the processed tobacco, now containing solid carbon dioxide, has coagulated into a coherent mass or a number of relatively large chunks. Such a mass slides along the wire mesh screen 40 as the processed tobacco 22 is withdrawn from the vessel 10.

Figure 3:
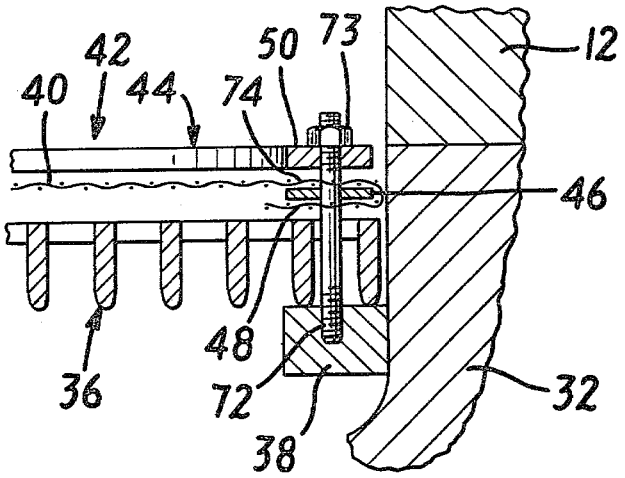
FIG. 3 is an enlarged sectional view of a portion of the door in FIG. 1 showing the details of a product support grating and a preferred embodiment of the apparatus for holding a wire mesh screen securely against the grating.
Figure 4:
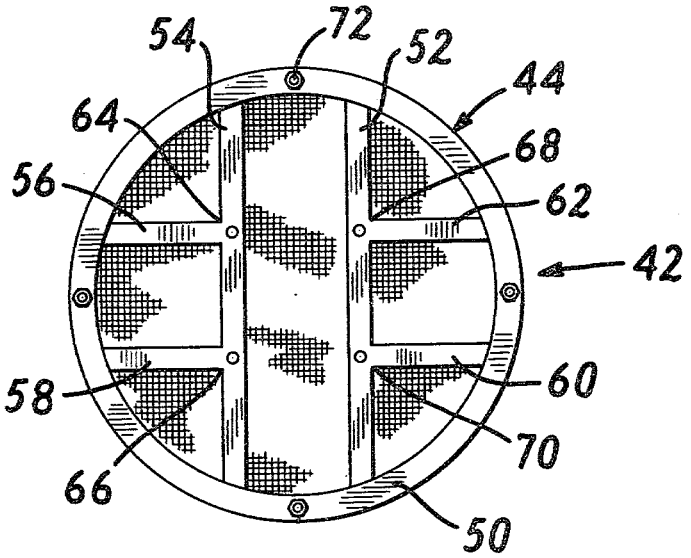
FIG. 4 is a plan view of a preferred embodiment of the invention showing a grid for holding the permeable member securely against the grating.

Referring to FIGS. 3 and 4, there is shown in accordance with the preferred embodiment of the invention, an apparatus 42 for minimizing stretching and tearing of the screen 40 during product discharge. In the preferred form, the apparatus 42 comprises a grid assembly 44 and a retention ring 46 to suitably hold the screen against the grating 36. In this arrangement, the grating 36, the wire mesh screen 40, the grid assembly 44 and the ring 46 are all substantially circular in shape. The screen 40 has a diameter of the grating 36, the outer diameter of the ring 46 being approximately the same as the diameter of the grating 36. The periphery of the screen 40 is folded around and beneath the retention ring 46 such that the ring folded portion 48 of the screen 40 is between the lower surface of the ring 46 and the upper surface of the grating 36.

The grid assembly 44 is disposed on the upper surface of the wire mesh screen 40. The grid assembly 44 comprises an outer peripheral ring portion 50 that has a diameter approximately the same as the diameter of the retention ring 46. A plurality of strips, for example, 52, 54, 56, 58, 60 and 62 are attached to the ring portion 50 and are angularly joined, for example, at locations 64, 66, 68 and 70 interiorly of the ring portion 50. Such angularly joined strips extend onto the interior surface of the screen 40 and partition the screen, preferably symmetrically, to hold the interior screen surface against the grating. The holding apparatus 42 is secured to the door shoulder 38 as by a stud bolt 72 with a hex nut 73. By so securing the apparatus 42, the unfolded outer radial portion 74 of the screen 40 is clamped between the outer peripheral ring portion 50 of the grid 44 and the upper surface of the retention ring 46, the folded screen portion 48 of the screen 40 is clamped between the lower surface of the retention ring 46 and the grating 36, and the interior surface portions of the screen 40 are held against the grating 36 by the angularly joined strips. To further assure sufficient holding of the interior surfaces of the screen, the joined strips may be bolted to the grating 36 at the joints 64, 66, 68 and 70.

In one example of such a screen holding apparatus 42, the grid was formed of flatbar steel 0.25 inch (0.635 cm.) thick, the width of the outer peripheral ring portion 50 and all the strips 52, 54, 56, 58, 60 and 62 being about 1.5 inch (3.81 cm.) with the outer diameter of the grid ring portion 50 being about 4.0 feet (1.21 meter). In the preferred embodiment, the strips were joined as by welding to have a configuration substantially as shown in FIG. 4, thereby partitioning the interior surface into seven sections.

Although the holding apparatus 42 has been described herein in the preferred embodiment of the grid 44 and the retention ring 46, it should be appreciated that the retention ring 46 can be eliminated with the grid itself providing the holding of the screen 40 at its periphery and interior surfaces. In this instance the screen 40 need not be made to have a diameter larger than the diameter of the grating 36 but may have approximately the same diameter as the grating 36. Also, if the retention ring 46 is used, the joined strips may be eliminated with just the outer peripheral portion 50 serving as a clamping ring to clamp the screen 40 to the grating 36. Although such holding apparatuses would not provide the same degree of holding as with both the retention ring 46 and the grid 44 such apparatuses would still be an improvement over the currently used holding devices. In all of these arrangements, securely holding the screen 40 fixed relative to the grating 36 is effected at a location on the screen 40 proximate its periphery and also at a location on the screen 40 interiorly of the screen periphery. Such holding of the screen 40 effectively increases the bearing surface contact between the screen 40 and the grating 36 so as to increase the resistance of the screen 40 to sliding movement during discharge of the processed product.

It should also be appreciated that although the holding apparatus 42 is described herein as preferably of circular configuration that other shapes may also be used. For example, even where the vessel 10 and the door 18 is substantially circular, the grating 36 may be formed to have a square or triangular shape. The holding apparatus 42 of the present invention may be readily used with such diverse configurations.

Furthermore, it should also be appreciated that even though the present invention has been described herein as an improvement in pressure vessels for use in impregnating tobacco with liquid carbon dioxide the invention is also applicable to other pressure vessels in which a liquid cryogen is used to process products such as food.

What is claimed is:

1. In a pressure vessel of the type used for processing a product with a liquid cryogen said vessel including means for introducing product to be processed and means for withdrawing processed product, wherein said withdrawal means includes a door pivotally hinged to open to permit gravitational discharge of the processed product from said vessel, said door including a grating to support said product in said vessel when said door is closed and a wire mesh screen on said grating having a periphery greater than the periphery of said grating, to permit passage therethrough of gaseous and liquid cryogen while substantially preventing product from passing therethrough, an apparatus for minimizing stretching and tearing of said screen during discharge of said processed product comprising means for securely holding said screen fixed relative to said grating proximate the periphery of said screen, said holding means including means for further securely holding said screen at a location interior of the periphery of said screen, the periphery of said screen being folded around and beneath a retention band having an outer periphery approximately the same as the periphery of said grating, said holding means including means for clamping the folded periphery of said screen between the retention band and said grating.

2. An apparatus according to claim 1, wherein said grating, said screen and said retention band are substantially circular and wherein said clamping means comprises a clamping ring having an outer periphery approximately the same as the periphery of said retention band, said clamping ring being disposed on said screen to hold the outer unfolded radial portion of said screen between the clamping ring and said retention band.

3. An apparatus according to claim 2, wherein said holding means further includes means attached to said clamping ring and extending interiorly of the periphery of said screen onto a surface portion thereof for holding the interior surface of said screen against said grating.

4. An apparatus according to claim 3, wherein said interior surface holding means comprises a plurality of strips joined angularly to provide a grid substantially symmetrically partitioning said interior surface.

5. An apparatus according to claim 1, wherein said holding means comprises a grid including a peripheral portion having a periphery substantially conforming to the periphery of said permeable member and a plurality of strips attached to said peripheral portion and extending interiorly of said peripheral portion onto the interior surface of said permeable member whereat said strips are joined angularly at a plurality of locations to thereby form said grid partitioning said interior surface of said permeable member and means for clamping said permeable member between said grid and said grating.

6. In a pressure vessel of the type used for impregnating tobacco with liquid carbon dioxide and converting the liquid carbon dioxide impregnating said tobacco to solid carbon dioxide therein, said vessel including means for introducing tobacco to be impregnated and means for withdrawing solid carbon dioxide containing tobacco, wherein said withdrawal means includes a door pivotally hinged to open to permit gravitational discharge of the impregnated tobacco from said vessel, said door including a substantially circular grating to support said tobacco in said vessel when said door is closed and being supported by a shoulder formed radially internally of said door, a circular wire mesh screen having a diameter greater than the diameter of said grating to permit passage therethrough of gaseous and liquid carbon dioxide while substantially preventing tobacco from passing therethrough, wherein the improvement comprises means for securely holding said wire mesh screen fixed relative to said grating at a location proximate the periphery of said screen and at a location interiorly of the periphery of said screen to minimize stretching and tearing thereof during discharge of said impregnated tobacco, the periphery of said screen being folded around and beneath a retention ring having an outer diameter approximately the same as the diameter of the grating, a grid on said screen, said grid including an outer ring portion having a diameter approximately the same as the diameter of said retention ring and a plurality of strips angularly joined interiorly of said peripheral portion; and means for securing said grid to said door such that the folded peripheral portion of the screen is held between the retention ring and the grating, the outer radial unfolded portion of the screen is held between the outer ring portion of said grid and the retention ring and the interior surface portion of said screen is held between said joined strips and said grating.

* * * * *